US006477875B2

(12) United States Patent
Field et al.

(10) Patent No.: US 6,477,875 B2
(45) Date of Patent: Nov. 12, 2002

(54) ROTATING PIN TUMBLER SIDE BAR LOCK WITH SIDE BAR CONTROL

(75) Inventors: Peter H. Field, Salem, VA (US); Andy E. Perkins, Lafayette, VA (US)

(73) Assignee: Medeco Security Locks, Inc., Salem, VA (US)

( * ) Notice: Subject to any disclaimer, the term of this patent is extended or adjusted under 35 U.S.C. 154(b) by 0 days.

(21) Appl. No.: 09/981,801

(22) Filed: Oct. 19, 2001

(65) Prior Publication Data

US 2002/0104346 A1 Aug. 8, 2002

Related U.S. Application Data

(63) Continuation-in-part of application No. 09/776,929, filed on Feb. 6, 2001, now abandoned.

(51) Int. Cl.[7] ..... E05B 27/04; E05B 27/08

(52) U.S. Cl. ..... 70/491; 70/494; 70/495; 70/496

(58) Field of Search ..... 70/409, 491, 493, 70/494, 495, 496

(56) References Cited

U.S. PATENT DOCUMENTS

| | | | | | |
|---|---|---|---|---|---|
| 2,023,847 | A | * | 12/1935 | Liss | 70/377 |
| 3,425,248 | A | * | 2/1969 | Duval | 70/421 |
| 3,492,843 | A | * | 2/1970 | Schieber et al. | 70/388 |
| 3,499,302 | A | * | 3/1970 | Spain et al. | 70/494 |
| 3,748,881 | A | * | 7/1973 | Erickson | 70/388 |
| 4,098,103 | A | * | 7/1978 | Raskevicius | 70/494 |
| 4,735,069 | A | * | 4/1988 | Steinbach | 70/409 X |
| 5,570,601 | A | * | 11/1996 | Field | 70/494 X |
| 5,615,566 | A | * | 4/1997 | Brandt | 70/419 |
| 5,839,307 | A | * | 11/1998 | Field et al. | 70/283 |
| 2002/0056301 | A1 | | 5/2002 | Theriault et al. | |

* cited by examiner

*Primary Examiner*—Lloyd A. Gall
(74) *Attorney, Agent, or Firm*—Rothwell, Figg, Ernst & Manbeck

(57) ABSTRACT

A twisting tumbler lock with a side bar is provided with additional levels of security by a axially reciprocable slider which is normally positioned to block operation of the side bar but is moved by a specially configured key to free operation of the side bar. This provides a third level of locking security, it also allows master keying. The unique key has a portion of a rib formed to cooperate with the slider to further allow key control.

15 Claims, 7 Drawing Sheets

ROTATING PIN TUMBLER SIDE BAR LOCK WITH SIDE BAR CONTROL

REFERENCE TO RELATED APPLICATIONS

This application is a continuation-in-part of application Ser. No. 09/776,929 filed Feb. 6, 2001, now abandoned.

BACKGROUND OF THE INVENTION

1. Field of the Invention

This invention relates to improvements in rotating pin tumbler side bar locks and keys therefor.

2. Background and Prior Art

Rotating or twisting tumbler locks with side bar control of the tumblers and keys for operating such locks are well known in the prior art and have been manufactured and sold by Medeco Security Locks, Inc. Of Salem, Va. for over twenty years. Examples are in the following patents assigned to Medeco Security Locks, Inc. U.S. Pat. No. 3,499,302 Spain et al (1970) U.S. Pat. No. 3,722,240 Spain et al (1973), U.S. Pat. No. 4,635,455 Oliver (1987), U.S. Pat. No. 5,289,709 Field (1994), U.S. Pat. No. 5,419,168 Field (1995), U.S. Pat. No. 5,570,601 Field (1996), U.S. Pat. No. 5,615,565 Field (1997) and U.S. Pat. No. 6,023,954 Field (2000).

Security is a necessary feature of a lock and additional security that could be applied to twisting tumbler locks with dual mechanisms would be highly desirable.

A further and extremely desirable feature of a high security lock is the capability for master keying. Providing additional security and utilizing such provision for master keying provides capability for master keyed systems.

It is also advantageous to have a unique key and key blank for locks of the type in order to provide the additional security that key control can accomplish.

SUMMARY OF THE INVENTION

This invention relates to improvements to enhance the security of the basic twisting tumbler dual locking mechanism lock known as the Medeco type lock and can be applied to any Medeco type lock with a side bar mechanism including the original Medeco cylinder lock, the Medeco cam lock, the Medeco Biaxial® lock, and the Medeco Bi-Level® lock with offset tip tumbler pins. The invention utilizes a sliding member which slides generally axially in the cylinder of the lock and has a projection for contact with an end of a rib on a key blade. The key thus positions the slider which controls the side bar to allow the side bar to move to an unblocked position. The slider control of the side bar and the unique key and key blade provide further degrees of security, allow master keying and key control.

DETAILED DESCRIPTION OF THE PREFERRED EMBODIMENTS

Figure 3:
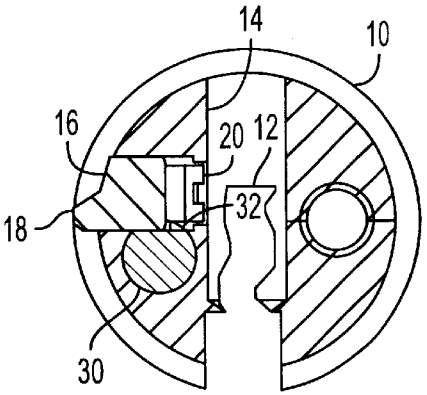
FIG. 3 is a horizontal section view taken along line 3—3 of FIG. 2.
Figure 2:
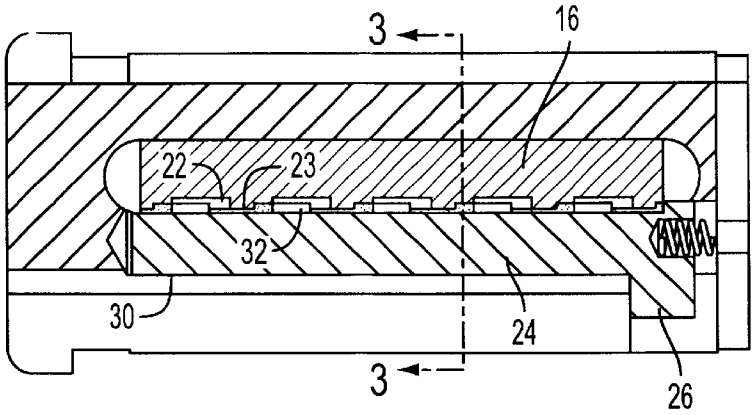
FIG. 2 is a longitudinal section view taken along line 2—2 of FIG. 1.
Figure 1:
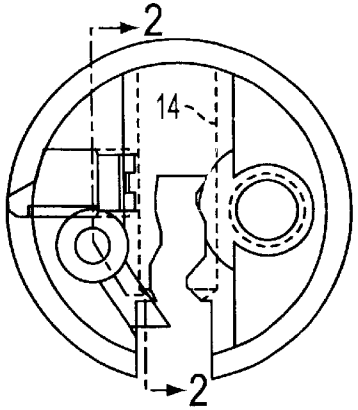
FIG. 1 is a end elevation view of the cylinder or plug of a twisting tumbler lock having a side bar.
Figure 4:
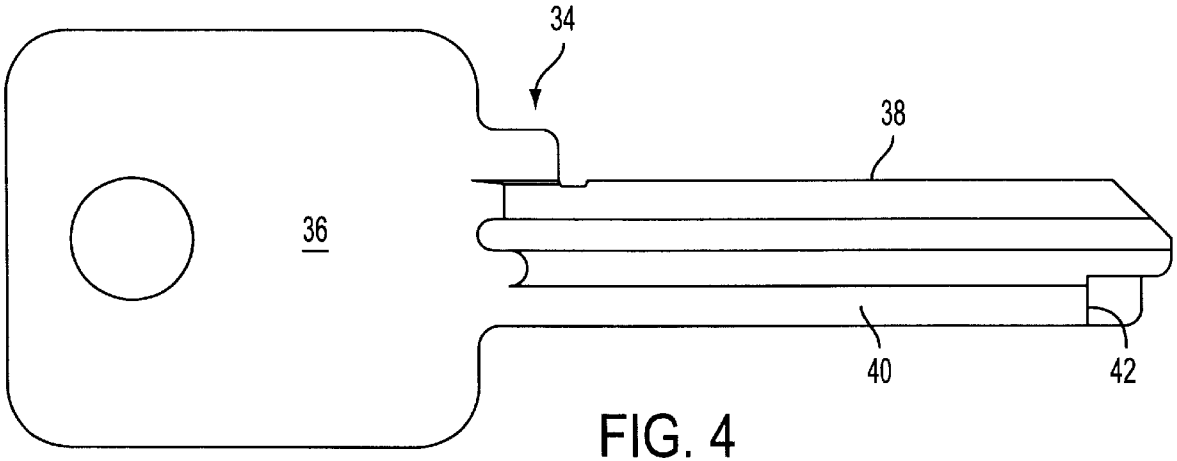
FIG. 4 is a plan view of a key blank of this invention.

As shown in FIGS. 1–3 a cylinder or plug 10 has a keyway 12 as is conventional in Medeco locks. Tumbler holes 14 are provided for rotating, reciprocating, i.e., twisting tumblers 11 (FIG. 12) which have configurations 13 on their side for reception of a side bar 16 as taught and shown in the prior art Medeco constructions and patents identified above, see FIGS. 12 and 13. Because remaining portions of such Medeco locks are known, for the sake of simplicity they have not been shown, except for the illustration of prior art in FIGS. 12 and 13.

The side bar 16 is positioned to reciprocate transverse to the axis of the cylinder plug 10 and biased by springs away from the plug to provide a further level of locking control for the lock, as is known. The side bar has a cam 18 for cooperating with a cam groove 19 on the inside of the casing, also as is conventional in Medeco locks, see FIG. 13. When the plug is attempted to be rotated by the key the cam groove 19 allows the side bar to be forced inwardly toward the center of the cylinder. The side bar has projections 20 for engaging the configurations 13 on the tumblers 11 to allow the side bar to move toward the axis of the plug and clear the casing when the tumblers are rotated by the key to a correct position, as in known Medeco locks.

In the present invention, the side bar also has spaced slots 22 positioned along its lower surface as shown in FIGS. 1 and 2. Projections 23 are defined by the spaces between the slots.

Positioned in an axial hole 30 in the cylinder plug is a slider 24 which can slide on an-r axis parallel to the axis of the rotatable cylinder plug. The slider itself has a projection 26 at one end which extends into the keyway 12 for engagement with proper key as will be described. A spring 28 is provided for biasing the slider axially in hole 30 in a duration toward the front or key entry point of the lock.

The slider 24 also has spaced tangs 32 on its surface as shown in FIGS. 1, 2 and 3. These tangs are of sufficient size and length to either fit in the slots 22 of the side bar when the slider is properly positioned, or interfere with the projections 23 on the side bar when not properly positioned. As shown in FIG. 2, the tangs 32 on the slider and projections 23 on the side bar 16 interact thus preventing the side bar from moving inwardly, thus blocking operation of the side bar and hence the lock.

Figure 5:
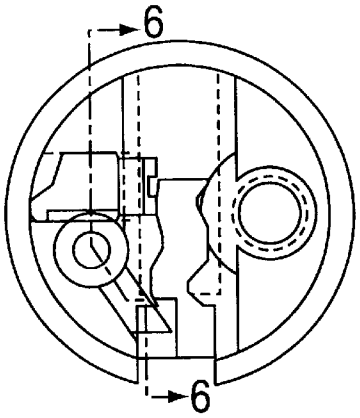
FIG. 5 is an end elevation view similar to FIG. 1 with the lock in unblocked position.
Figure 7:
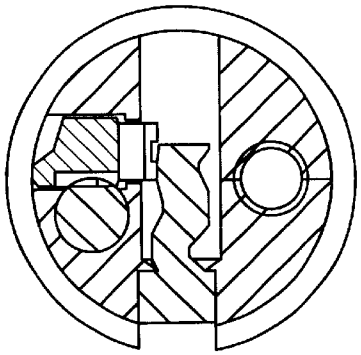
FIG. 7 is a longitudinal sectional view taken along lines 7—7 of FIG. 6.
Figure 6:
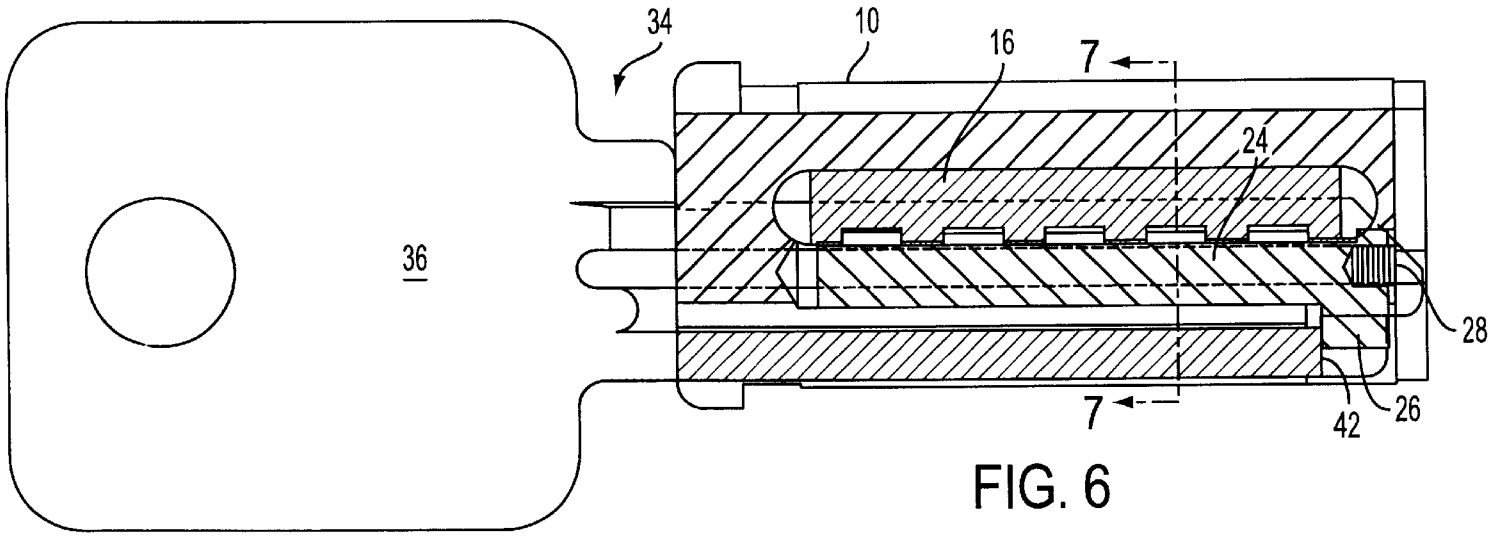
FIG. 6 is a longitudinal sectional view taken along lines 6—6 of FIG. 5.

As shown in FIG. 6 when the slider spring 28 has been compressed and the tangs 32 on the slider are positioned within the slots 22 of the side bar, the side bar is allowed to operate as shown in FIGS. 5 and 6. Thus, the slider provides a third level of lock control in addition to the reciprocation and rotation of the tumblers.

A unique key blank 34 may be provided with proper bitting 35 for operating the lock. The key blank has a bow 36 and a blade 38. The blade has a profile which conforms to the profile of the keyway 12. On the side of the key blank (and the key) there is a rib 40 having a contact surface 42 formed for contacting the projection 26 on the slider 24. As shown in FIG. 6, when the key is inserted and rib end 42 contacts projection 26 it compresses spring 28 and positions the slider so as to not to interfere with operation of the side bar.

Figure 10:
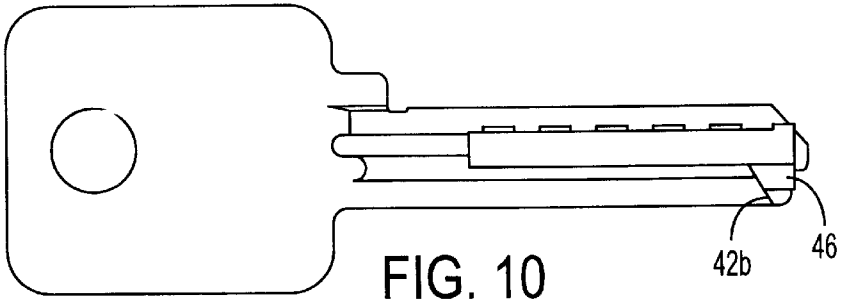
FIGS. 8, 9, 10 and 11 are alternative embodiments showing a cut key of this invention with the slider superposed thereon to illustrate the possibilities of master keying.
Figure 11:
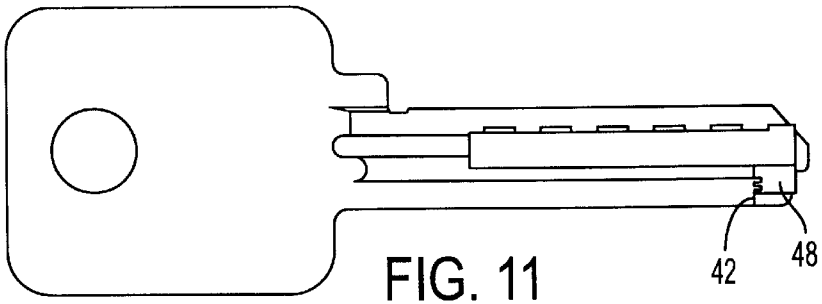
Figure 8:
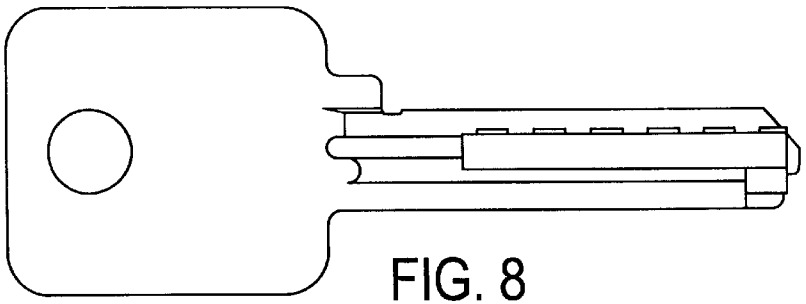
Figure 9:
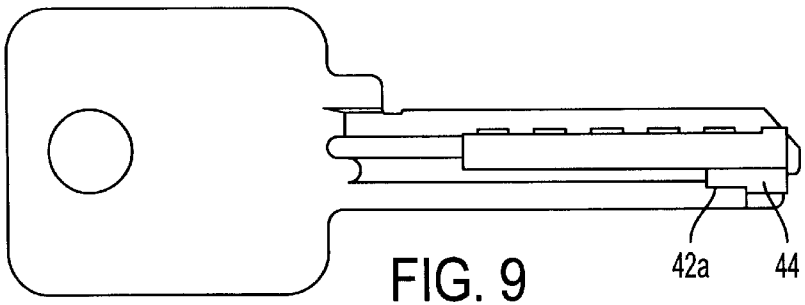

FIGS. 8, 9, 10 and 11 show other embodiments having different configurations of the contact surface 42 on key rib 40 and showing the slider 24 superimposed, the slider projection 26 having a surface complementary to the contact surface 42. FIG. 8 is the same as the FIGS. 1–7 embodiment, but in the open position of FIG. 6. In FIG. 9 the slider projection has a step 44 for receiving a similarly configured key rib end 42*a*. FIG. 10 has a slanting surface 46 for cooperating with a slant surface 42*b* on the distal end of key rib 40. FIG. 11 has a tooth shaped surface 48 on projection 26 for cooperating with a complementary shaped rib surface 42. To illustrate master keying possibilities, the key of FIG. 8 will correctly position the slider shown in FIG. 8 and the key of FIG. 11 will correctly operate the slider in FIG. 11. The key in FIG. 8 will also correctly position the slider of FIG. 11. However, the key of FIG. 11 will push the slider of FIG. 8 too far and the lock will not open. Similarly, the key of FIG. 8 will not operate with a slider configured as in FIG. 9 or as in FIG. 10 because it would push the slider too far and the lock will not open. By providing different keys with differently configured distal ends of the key rib, and providing different cylinders with differently configured slider projections, the cylinders can be selectively operated by the different keys.

Figure 13:
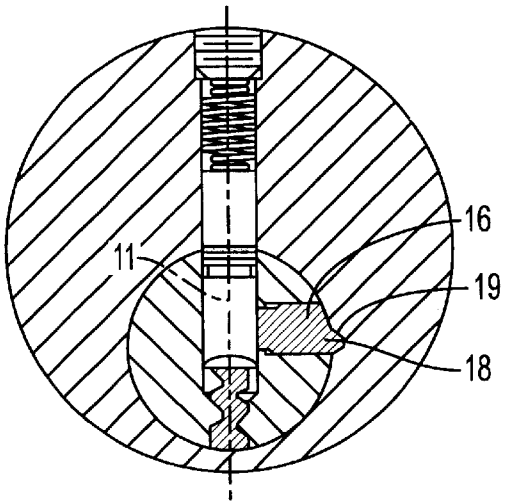
FIG. 13 (PRIOR ART)
FIG. 13 is a sectional view taken along line 13—13 of FIG. 12.
Figure 12:
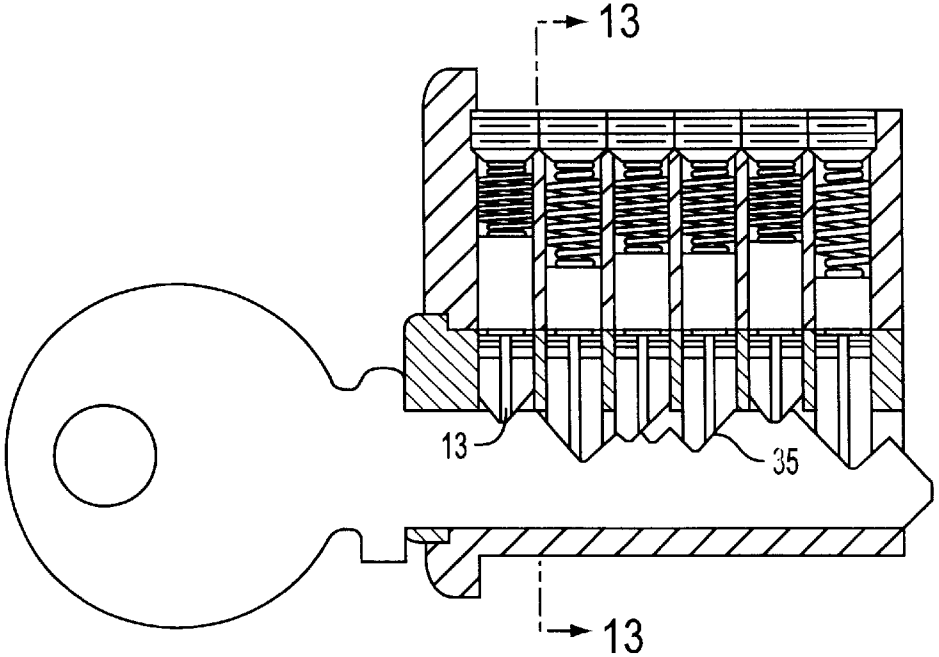
FIG. 12 (PRIOR ART)
FIG. 12 is a sectional elevation view of the prior art, Medeco cylinder lock, to show the setting of this invention.
Figure 15:
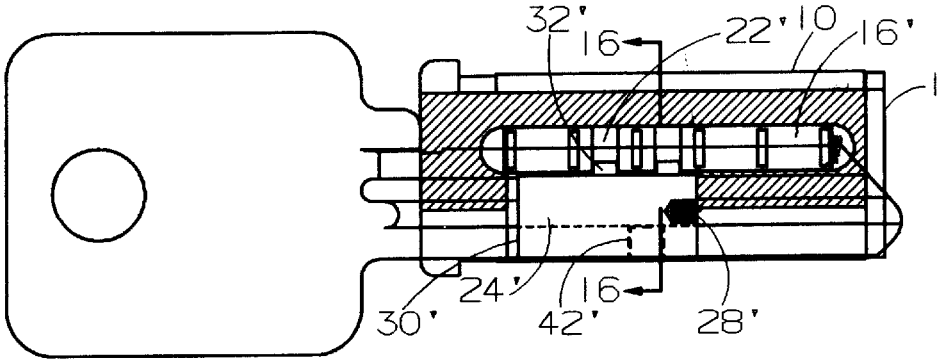
FIG. 15 is a longitudinal sectional view taken along line 15—15 of FIG. 14.
Figure 16:
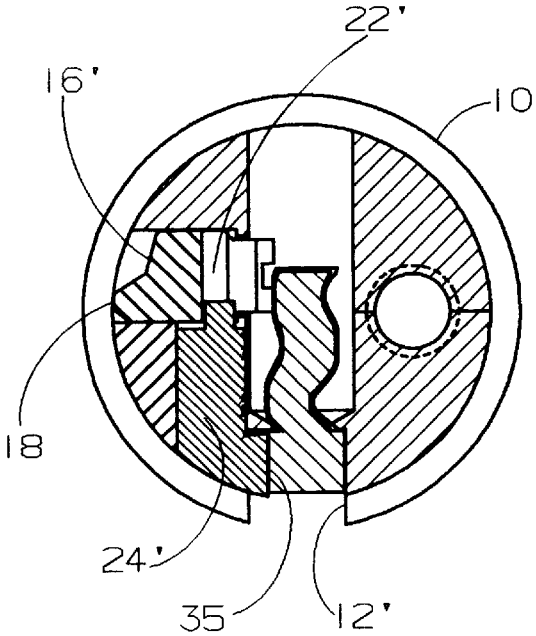
FIG. 16 is a horizontal view taken along line 16—16 of FIG. 15.
Figure 14:
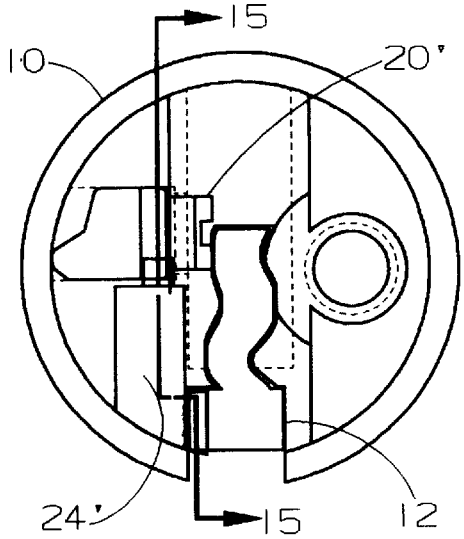
FIG. 14 is an end elevational view of the cylinder of a twisting tumbler lock having a side bar and showing a further embodiment of this invention.
Figure 18:
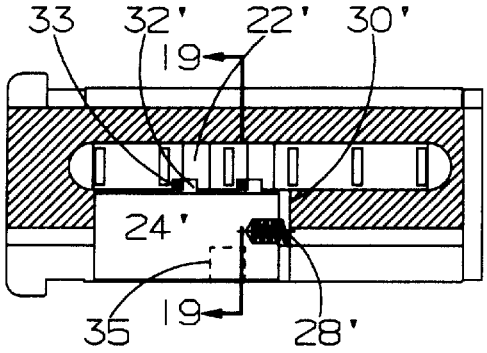
FIG. 18 is a longitudinal section view taken along line 18—18 of FIG. 17.
Figure 19:
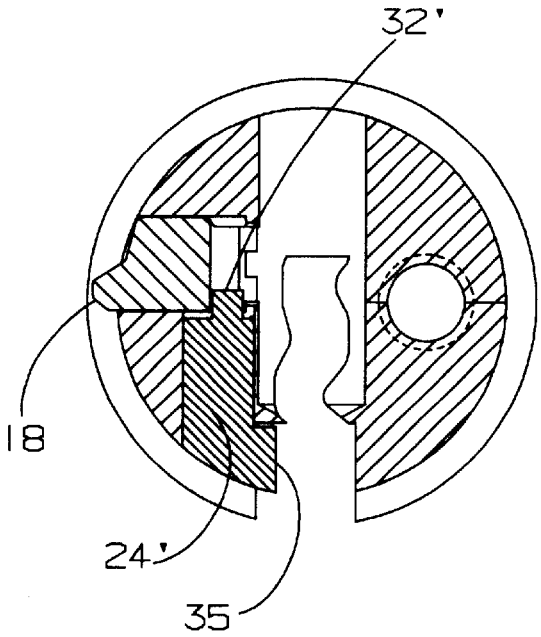
FIG. 19 is a horizontal sectional view taken along line 19—19 of FIG. 18.
Figure 17:
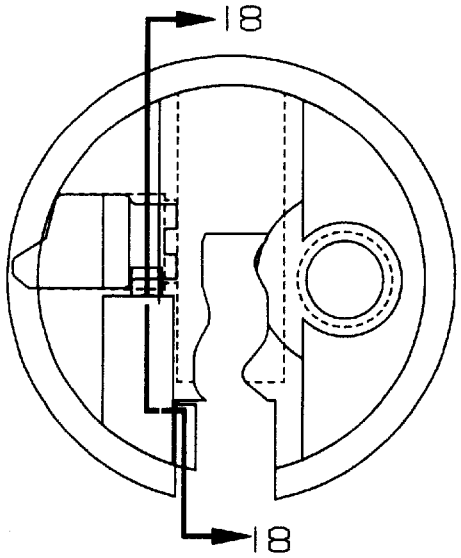
FIG. 17 is an end elevational view of the cylinder shown in FIG. 14 showing the components of the cylinder in their locked position.

FIGS. 14–20 show an alternative embodiment in which the blocking member or slider instead of being a rod insertable into the end of the cylinder is in the form of a block which is insertable from the bottom of the keyway. This is shown in more detail with reference to FIGS. 14, 15 and 16 showing the slider in position to not block the side bar. As shown the plug 10 has its keyway 12 open at the bottom. The side bar 16' has spaced slots 22' which will allow the sidebar to either clear or be blocked by the slider as will be described below. As with the prior described embodiment, the invention is in the environment of the Medeco twisting tumbler locks as shown in FIGS. 12 and 13 in which the side bar 16 reciprocates transverse to the axis of the cylinder plug to provide a higher level of locking and the side bar is biased inwardly by springs to either be held by or passed over and out of cam groove 19 on the inside of the casing which cooperates with cam 18 on the side bar as shown in FIGS. 16 and 19 and as is conventional in Medeco locks. When the plug is attempted to be rotated by a key, the cam 18 causes the side bar 16' to be forced inwardly toward the center of the cylinder. The side bar has projections 20' for cooperating with the twisting cylinders as is known in the art. The side bar also has spaced slots 22' positioned along its side surface.

Figure 20:
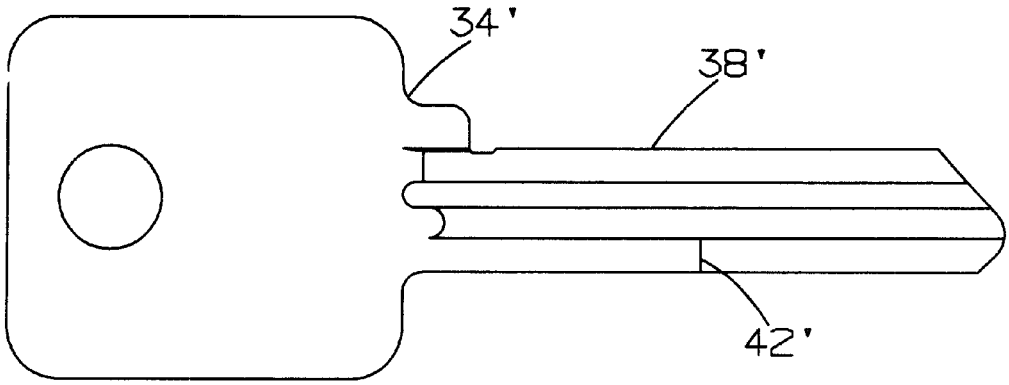
FIG. 20 is a plan view of a key blank for key of this invention.

The slider in this embodiment is a block shaped member 24' shaped to fit within the cylinder shell and to be inserted from the open bottom of the keyway 12. A spring 28' is provided by biasing the slider toward the bow of the key as shown in FIGS. 15 and 18. The slider moves axially of the key in space 30'. The plug shaped slider has spaced tangs 32' on its upper surface as shown in FIGS. 15 and 18. These tangs can move into slots 22' in the side bar when the slider is positioned by the key as shown in FIGS. 15 and 16. However, as shown in FIG. 18, when the key is not moving the slider, the tangs 32' intersect with the portions of the side bar outside the slots 22' as indicated by interference points 33 and this prevents the side bar from moving axially inwardly and prevents the lock from being operated to accomplish unlocking. This would happen at all times except when a proper key such as key 34' shown in FIG. 20 is inserted into keyway 12 to move the slider member 24' from the normal position of FIG. 18 to the unlocking position of FIG. 15. This is accomplished by a further projection 35 on the slider 24' which extends into the keyway so as to intersect with the profile of the key blade 38'. The key blade has a stop 42' which contacts projection 35 and compresses the spring 28' when the key is inserted to allow the side bar to operate when the tangs 32' are in the grooves 22' as shown in FIG. 15.

In operation the key 34' is inserted into the keyway 12 to move the slider 24' against the bias of spring 28' and when the projections 32' are in the position to cooperate with grooves 22', the side bar 16' can operate to allow the key to turn the plug and operate the lock. Unless the portion 42' of the key 34' contacts the projection of 35, the slider or block 24' will block operation of the lock.

The keys of FIGS. 8–11 could also be used with this embodiment.

The advantage of this construction is that it allows master keying and provides further security because it does not require the conventional pin and tumbler master keying techniques to be used to configure the locks with the selective master keying capability. When used to supplement conventional master keying techniques, it provides additional capability thus offering the customer the most secure system.

Although the present invention has been described with reference to the particular embodiments disclosed, it is understood that these embodiments are merely illustrated of the application and principles of the invention. Numerous other configurations can be made and other arrangements can be devised without departing from the spirit and scope of the invention as defined in the appended claims.

We claim:

1. A cylinder lock of the type having a rotatable cylinder with an axis and a keyway, the lock being controlled by rotatable reciprocating tumblers which are selectively contacted by a side bar under control of a key, with the improvements comprising;

a moveable member separate from the tumblers and operable by contact with the key and cooperating with the side bar to control locking movement of the side bar and control operation of the lock, wherein the moveable member is a slider which slides in the cylinder parallel to the axis of the cylinder.

2. A cylinder lock as defined in claim 1, wherein the slider is biased in a direction parallel to the axis of the cylinder.

3. A cylinder lock as defined in claim 2, wherein the bias is provided by a spring in the cylinder to force the slider in a direction toward an entrance of the keyway.

4. A cylinder lock as defined in claim 2, wherein the slider has an extension which extends into the keyway for contacting the key.

5. A cylinder lock as defined in claim 4, wherein the extension is a projection shaped to cooperate with a portion of a key when inserted into the keyway.

6. A cylinder lock as defined in claim 2 wherein the slider is insertable into the lock through a keyway opening therein.

7. A cylinder lock as defined in claim 2 wherein the slider is insertable longitudinally into the end of the cylinder.

8. A key in combination with a cylinder lock as defined in claim 1, the key fitting into a keyway of the cylinder, a rib on the key, a portion of the rib positioned to contact and control locking movement of the movable member when the key is inserted into the keyway.

9. A master keying system comprising a cylinder lock as defined in claim 1 and keys as defined in claim 8, the keys having different configurations on the key and slider so that one key will operate to control and another key will not control operation of the slider.

10. A cylinder lock combination, including a rotatable cylinder with an axis and a keyway therein, the cylinder being controlled by rotatable reciprocating tumblers which contact and further control a side bar with the improvements comprising, a slider carried by the cylinder, a spring for biasing the slider to a position toward entrance of the keyway, the slider having spaced tangs, the side bar having spaced projections, the tangs on the slider and the projections on the side bar interfering with each other to prevent operation of the side bar unless the slider is moved against the bias of the spring until the tangs of the slider are within spaces between the side bar projections, the slider having a projection with a contact surface which extends into the keyway, and a key configured for insertion into the keyway, the key having a contact surface for contacting the contact surface of the projection on the slider and moving the slider against the bias of the spring to a position where the tangs on the slider clear the projections on the side bar.

11. A cylinder lock combination as in claim 10 wherein the slider is insertable into the lock through a bottom of the keyway.

12. A cylinder lock combination as in claim 10, wherein the slider is insertable longitudinally into the lock through an opening in the end of the cylinder.

13. A key and a cylinder lock having a rotatable cylinder with an axis and a keyway, rotatable reciprocating tumblers, a movable side bar for contacting the tumblers and a slider for controlling operation of the side bar, a projection on the slider extending into the keyway; the key comprising a key bow, a key blade with a profile complementary to the configuration of the profile of the keyway, at least one rib on the key, and a contact surface on the rib for cooperating with the projection and moving the slider in the cylinder parallel to the axis of the cylinder to unblock the side bar.

14. A cylinder lock having a rotatable cylinder with an axis and a keyway therein, the lock being controlled by rotatable reciprocating tumblers which contact and control a side bar, with the improvement comprising, a slider carried by the cylinder, a spring for biasing the slider toward the entrance to the keyway, the slider having spaced tangs, the side bar having spaced projections, the tangs on the slider and the projections on the side bar interfering with each other to prevent operation of the side bar unless the slider is moved against the bias of the spring until the tangs of the slider are within spaces between the side bar projections, and the slider having a projection with a contact surface which extends into the keyway for cooperation and activation by a proper key insertable into the keyway.

15. A cylinder lock as defined in claim 14 wherein the contact surface on the slider projection is shaped to cooperate with various shaped contact surfaces on keys for the lock to provide master keying.

* * * * *